United States Patent [19]

Shopsky

[11] Patent Number: 4,472,152

[45] Date of Patent: Sep. 18, 1984

[54] IGNITER CONSTRUCTIONS AND METHODS OF MAKING THE SAME

[75] Inventor: Harvey J. Shopsky, Latrobe, Pa.

[73] Assignee: Robertshaw Controls Company, Richmond, Va.

[21] Appl. No.: 337,610

[22] Filed: Jan. 7, 1982

Related U.S. Application Data

[63] Continuation-in-part of Ser. No. 178,810, Aug. 18, 1980, Pat. No. 4,374,338.

[51] Int. Cl.[3] ..... H01T 13/20

[52] U.S. Cl. ..... 445/7; 313/122; 313/125

[58] Field of Search ..... 313/118, 122, 125; 431/263, 264; 361/253; 445/7

[56] References Cited

U.S. PATENT DOCUMENTS 4,288,210 9/1981 Leonard et al. ..... 313/143 X
4,386,385 5/1983 Hamilton ..... 313/141 X

FOREIGN PATENT DOCUMENTS 1551681 3/1970 Fed. Rep. of Germany ..... 361/253

*Primary Examiner*—Palmer C. Demeo
*Attorney, Agent, or Firm*—Candor, Candor & Tassone

[57] ABSTRACT

The combination of a frame and an igniter body secured in an opening passing through opposed sides of the frame so that an igniter electrode carried by the igniter body projects beyond one of the sides of the frame and a lead of the igniter electrode extends beyond the other of the sides of the frame. The igniter body is a one-piece member having an integral medial shoulder abutting against the other side of the frame. A fastening member engages the one side of the frame and is operatively interconnected to the ingniter body to hold the shoulder thereof against the other side of the frame.

10 Claims, 31 Drawing Figures

IGNITER CONSTRUCTIONS AND METHODS OF MAKING THE SAME

CROSS-REFERENCE TO RELATED APPLICATION

This application is a continuation-in-part patent application of its copending parent patent application, Ser. No. 178,810, filed Aug. 18, 1980, now U.S. Pat. No. 4,374,338.

BACKGROUND OF THE INVENTION

1. Field of the Invention

This invention relates to an improved igniter assembly for providing ignition means for a fuel burning apparatus or the like and to methods of making such assemblies or the like.

2. Prior Art Statement

It is known to provide a combination of an igniter body and an outer target bracket that has a target electrode adapted to be disposed in spaced relation to an igniter electrode carried by the igniter body to define a spark gap therewith and that has mounting means for securing the bracket to a frame means adjacent the igniter body to provide the spark gap through which sparking can take place to ignite gaseous fuel being directed thereto by a flash tube arrangement or the like in order to ignite main burner means disposed remote therefrom.

In one type of such prior known arrangement, each igniter body is secured or loosely assembled to the frame means independently of the respective target bracket therefor and, thereafter, the respective target bracket is assembled to the frame means to cooperate with its respective igniter body in the above manner.

One such arrangement requires the igniter body to be disposed against one side of a frame plate and have a projecting part thereof pass through an opening in the frame plate and be fastened to the other side of the frame plate by a fastening member whereby an ignition electrode carried by the igniter body will project from the one side of the frame plate.

In another type of such prior known arrangement, each igniter body is secured in its respective target bracket by internally disposed means of the outer surrounding target bracket so that the resulting self-contained assembly can be subsequently secured as a single unit to the frame means by the mounting means of the target bracket.

It is also known to provide an igniter body and an igniter electrode carried by the body and being disposed in an opening passing through the body so that the electrode will be exposed at one end of the opening and a lead means interconnected to the electrode can extend therefrom out through the other end of the opening for external attachment purposes, such igniter electrode being secured in the opening of the igniter body by a wedging action of a plurality of axially aligned dished, disk-like fins on the electrode diametrically wedging in a tapering portion of the opening of the igniter body.

It is also known to provide a combination of a frame means and an igniter body secured in an opening passing through opposed sides of the frame means so that an igniter electrode carried by the igniter body projects beyond one of the sides of the frame means and lead means of the igniter electrode extends beyond the other of the sides of the frame means, the igniter body being a one-piece member having integral medial shoulder means abutting against the one side of the frame means and the fastening means engaging the other side of the frame means and being operatively interconnected to the igniter body to hold the shoulder means thereof against the other side of the frame means. The shoulder means is defined by an annular groove formed in the substantially cylindrical igniter body with the shoulder means facing away from the electrode end and the annular groove being adapted to receive the fastening means therein whereby the electrode wire thereof must first be threaded through the frame opening and the fastening means applied under the frame means at the opening thereof.

SUMMARY OF THE INVENTION

One feature of the invention of the aforementioned parent patent application is to provide an improved combination of an igniter body and a target bracket therefor.

In particular, it was found, according to the teachings of such invention, that a combination of an igniter body and a target bracket therefor can be provided in a unique manner so that the same can be assembled together in a simple and inexpensive manner to provide a self-contained assembly that can be subsequently secured as a single unit to the frame means of the apparatus utilizing the same.

For example, one embodiment of such invention provides a combination of an igniter body and an outer target bracket that has a target electrode adapted to be disposed in spaced relation to an igniter electrode carried by the igniter body to define a spark gap therewith and that has mounting means for securing the bracket to a frame means adjacent the igniter body to provide the spark gap, the target bracket having holding means holding the igniter body therein to provide a self-contained assembly that can be subsequently secured as a single unit to the frame means by the mounting means of the target bracket. The target bracket has slot means therethrough defining opposed surface means thereof, the igniter body having abutment means projecting out through the slot means. The holding means comprise cantilevered tab means of the target bracket engageable with the abutment means and defining one of the opposed surface means of the bracket.

Another feature of such invention is to provide an improved combination of an igniter body and an igniter electrode carried thereby.

In particular, it was found according to the teachings of such invention, that the igniter electrode can be formed of a single part and be so constructed and arranged within the igniter body that the electrode can be wedged into the opening of the igniter body by a single tab of the electrode to provide the sole means for securing that electrode to the igniter body so that auxiliary fastening means are not required.

For example, one embodiment of such invention provides the combination of an igniter body and an igniter electrode carried by the body and being disposed in an opening passing through the body so that the electrode will be exposed at one end of the opening and a lead means interconnected to the electrode will extend therefrom out through the other end of the opening for external attachment purposes, the electrode being wedged into the opening of the body to provide the sole means for securing the electrode to the body. The opening of the igniter body defines internal shoulder means interrupted by the opening thereof. The electrode has a main portion engaging the shoulder means to provide for accurate positioning of the electrode in the opening. The main portion of the electrode has a tab extending therefrom, the tab providing a biasing force in the igniter body opening that causes the electrode to be wedged in that opening.

However, it was found according to the teachings of this invention that when an igniter body is being assembled to a frame means by having the main portion of the igniter body disposed on the side of the frame means that subsequently receives a target bracket, it is relatively difficult to assemble the fastening means on the other side of the frame means to the projecting portion of the igniter body.

Accordingly, it was found according to the teachings of this invention that the igniter body could be formed in such a unique manner that the fastening means therefor would be disposed on the side of the frame means that receives the target bracket so that the igniter electrode carried by the igniter body would be on the same side of the frame means as the fastening means.

For example, one embodiment of this invention provides a combination of a frame means and an igniter body secured in an opening passing through opposed sides of the frame means so that an igniter electrode carried by the igniter body projects beyond one of the sides of the frame means and lead means of the igniter electrode extends beyond the other of the sides of the frame means. The igniter body is a one-piece member having integral medial shoulder means abutting against the other side of the frame means. A fastening means engages the one side of the frame means and is operatively interconneted to the igniter body to hold the shoulder means thereof against the other side of the frame means.

Accordingly, it is an object of this invention to provide an improved combination of an igniter body and a frame means therefor, as well as a method of making the same, the combination and method of this invention having one or more of the novel features of this invention as set forth above or hereinafter shown or described.

Another object of this invention is to provide an improved igniter body, as well as a method of making the same, the igniter body and method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 4 is an enlarged cross-sectional view taken on line 4—4 of FIG. 1 and illustrates the assembly of FIG. 1 being secured to a frame means of an appliance or the like.

FIG. 12 is a view similar to FIG. 4 and illustrates the completed embodiment of FIG. 9 being secured to a frame means of an appliance or the like.

FIG. 19 is a view similar to FIG. 12 and illustrates the completed embodiment of FIG. 16 being secured to a frame means of an appliance or the like.

DESCRIPTION OF PREFERRED EMBODIMENTS

Figure 1:
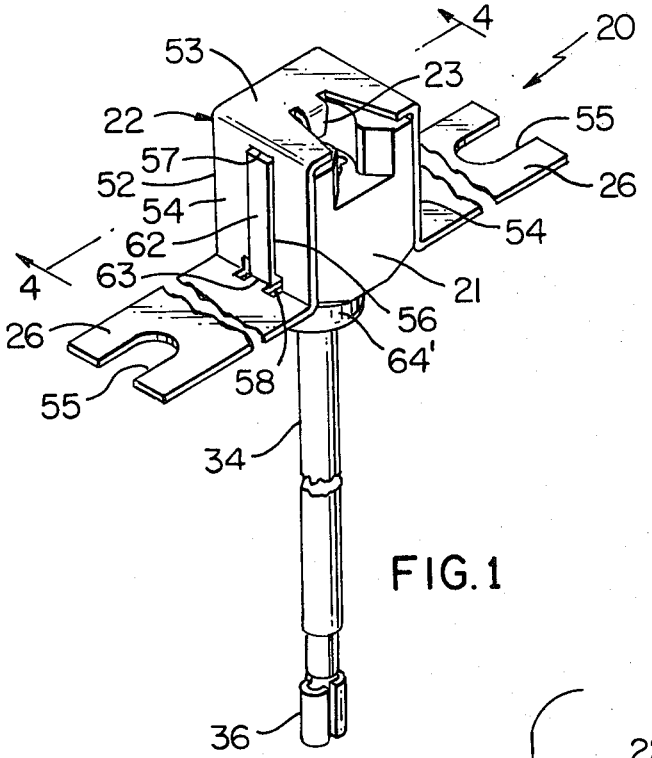
FIG. 1 is a perspective view of one embodiment of this invention that comprises the combination of an igniter body and a target bracket assembled thereto.

While the various features of this invention are hereinafter described and illustrated as being particularly adapted to provide an igniter arrangement for fuel burning cooking apparatus, it is to be understood that the various features of this invention can be utilized singly or in any combination thereof to provide an igniter arrangement for other fuel burning devices as desired.

Therefore, this invention is not to be limited to only the embodiments illustrated in the drawings, because the drawings are merely utilized to illustrate one of the wide variety of uses in this invention.

Figure 4:
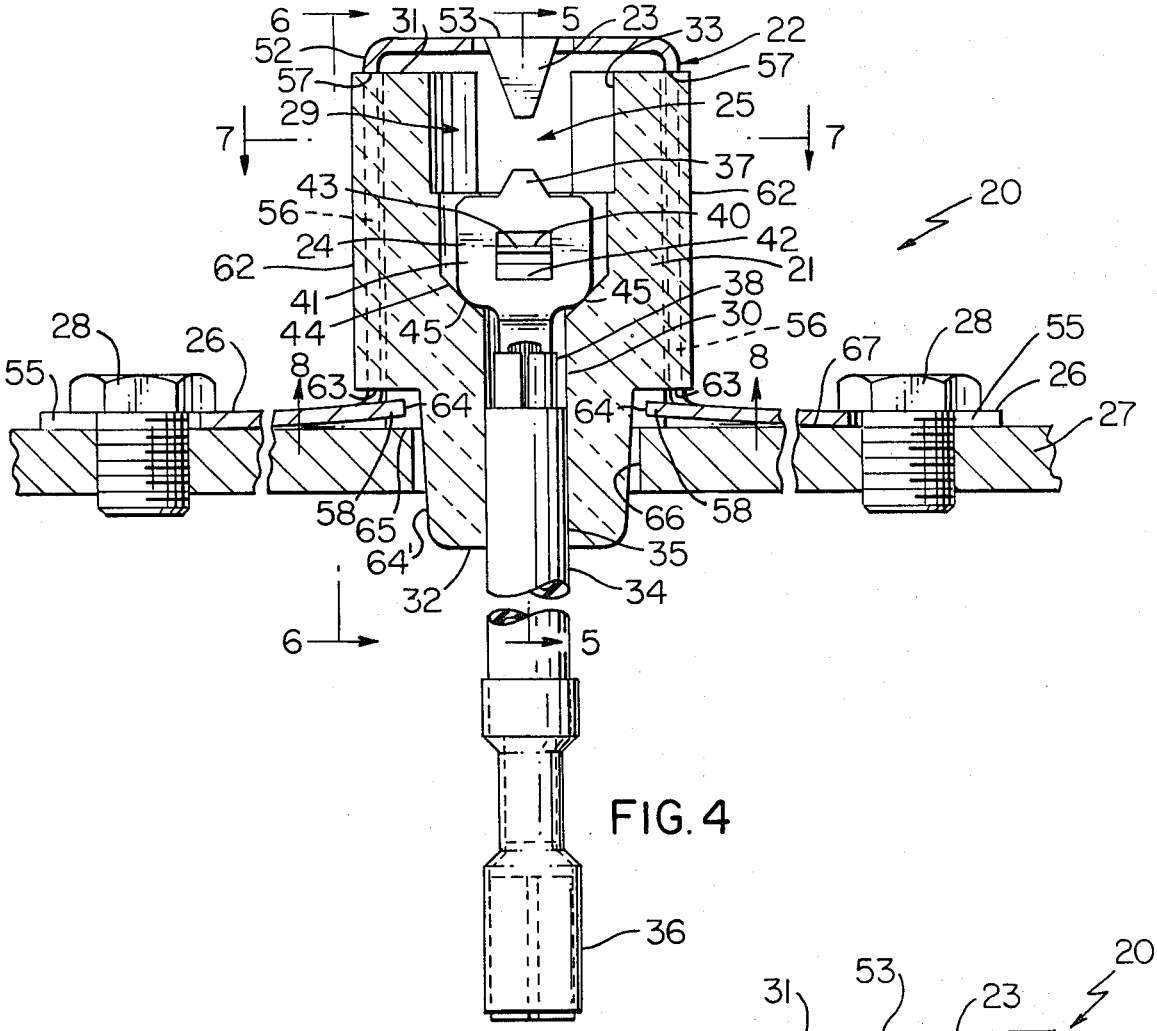

Referring now to FIGS. 1 and 4, the improved combination of this invention is generally indicated by the reference numeral 20 and comprises an igniter body 21 and a target bracket 22 that has a target electrode 23 disposed in spaced relation to an igniter electrode 24 carried by the igniter body 21 to define a spark gap 25 therewith and that has mounting means or leg portions 26 for securing the bracket 22 and assembled igniter body 21 to a frame means 27 of a fuel burning cooking apparatus or the like by threaded fastening members 28. In this manner, the target bracket 22 and igniter body 21 will be properly positioned relative to each other to cause electrical sparking across the spark gap 25 in a manner conventional in the art and hereinafter set forth to ignite gaseous fuel directed to a channel means 29 formed through the igniter body 21 and aligned with opening means of suitable flash tubes (not shown) in a manner conventional in the art.

For example, see the U.S. patent to Gross et al, U.S. Pat. No. 3,523,747, which illustrates and describes a typical flash tube arrangement together with an electrical igniter means for igniting fuel directed thereto from main burner means through the flash tubes so as to have the fuel issuing therefrom ignited by the electrical sparking at the electrical igniter means.

The igniter body 21 of this invention is formed of suitable electrical insulating material, such as a suitable ceramic material, and has a stepped opening 30 passing therethrough and interrupting the opposed ends 31 and 32 thereof whereby the igniter electrode 24 is adapted to be disposed in the opening 30 adjacent the upper end 33 thereof to be exposed to the target electrode 23 as illustrated in FIG. 4 and be interconnected to electrical lead means 34 that extends therefrom out of the lower end 35 of the opening 30 to be interconnected to a suitable and conventional electrical sparking unit (not shown) at the coupling end 36 thereof.

As previously stated, one of the features of this invention is to provide means whereby the igniter electrode 24 is secured within the opening 30 of the igniter body 21 in such a manner that auxiliary fastening means are not required.

This feature is accomplished by simply forming the electrode 24 as a stamped part from a metal sheet, such as 430 nickel-free stainless steel, so that the same has a pointed end 37 for cooperating with the target electrode 23 in forming the spark gap 25 and a coupling end 38 that can be crimped around the bared free end of the electrode wire of the lead means 34 in a conventional terminal coupling manner as illustrated.

A substantially rectangular tab 40 is carved from a medial or body portion 41 of the electrode 24 so as to have one end 42 integrally interconnected and hinged to the remainder of the electrode 24 while the free end 43 of the tab 40 is utilized to provide a wedging action within the opening 30 of the igniter body 21 to wedge the electrode 24 in its final position within the opening 30 for the sole securement therein as well as to center the electrode 24 so that its pointed end 37 will be properly aligned with the target electrode 23 in a manner hereinafter set forth.

The stepped bore 30 through the igniter body 21 defines an internal angular shoulder means 44 that comprises two flat shoulders that are angled in cross section as illustrated in FIG. 4 and is interrupted by the opening 30, the shoulder means 44 providing a surface against which opposed arcuate shoulders 45 of the electrode 24 will engage to properly position the pointed end 37 of the igniter electroode 24 in relation to the upper end 31 of the igniter body 21 so that when the upper end 31 of the igniter body 21 is properly positioned relative to the targe bracket 22 in a manner hereinafter set forth, an accurate and predetermined length for the spark gap 25 will be provided between the target electrode 23 and the igniter electrode 24 as will be apparent hereinafter.

Figure 7:
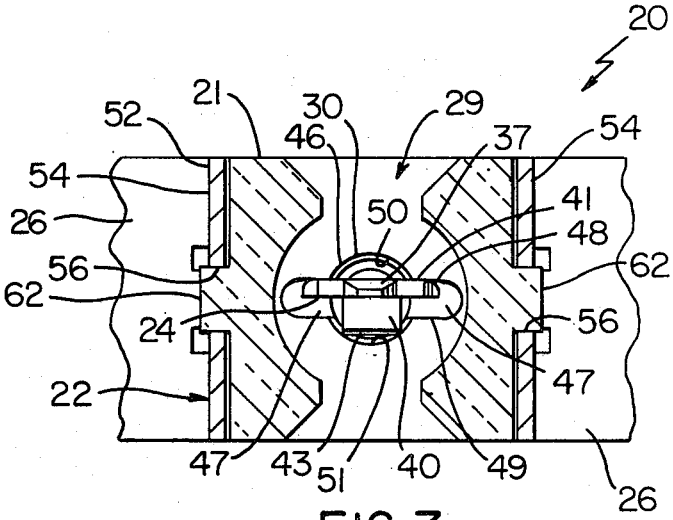
FIG. 7 is a fragmentary cross-sectional view taken on line 7—7 of FIG. 4.
Figure 8:
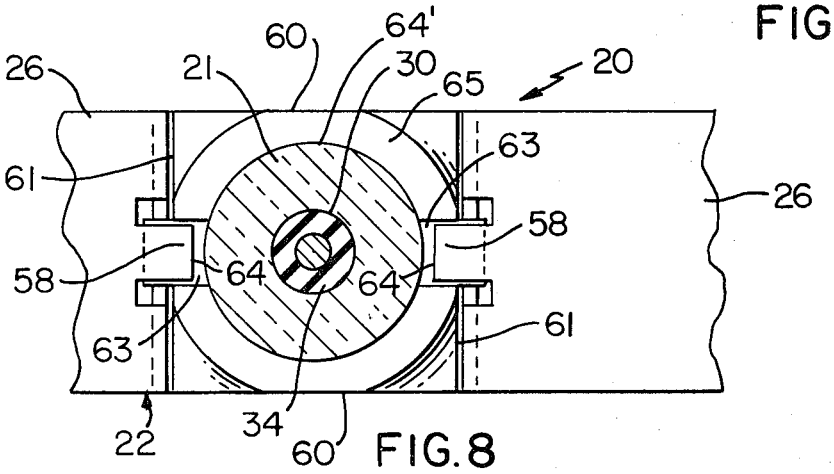
FIG. 8 is a fragmentary cross-sectional view taken on line 8—8 of FIG. 4.

The opening 30 in the igniter body 21 at the upper end 33 thereof defines not only a substantially cylindrical part 46 leading to the channel means 29, but also the opening 30 defines an elongated slot-like portion 47 that bisects the cylindrical portion 46 and extends beyond the same on opposite sides thereof to define a pair of opposed spaced flat internal surface means 48 and 49 of the igniter body 21 while the cylindrical portion 46 defines a pair of opposed arcuate internal surface means 50 and 51 interrupting those flat internal surface means 48 and 49 in a bisecting manner as illustrated in FIG. 7.

In this manner, with the tab 40 of the electrode 24 normally bent at a predetermined angle relative to the body 41 of the electrode 24, the lead means 34 thereof can be first inserted down through the portion 33 of the opening 30 to project out of the lower portion 35 thereof so that by subsequently pushing downwardly on the electrode 24 or pulling downwardly on the lead means 34 if the crimp fastening 38 can withstand such pull force, the igniter electrode 24 will be wedged down into the upper portion 33 of the opening by having the free end 43 of the tab 40 bear against one of the arcuate portions 50 or 51 of the cylindrical portion 46 of the opening 30 and thereby bias the body portion 41 of electrode 24 against the opposed flat surface 49 or 48 of the elongated portion 47 of the opening 30 so as to provide a wedging action therebetween and thereby hold the electrode 24 in the igniter body 21 in its final position where its lower shoulders 45 are disposed against the angular shoulder means 44 of the igniter body 21 in the manner illustrated in FIG. 4.

For example, as illustrated in FIG. 7, the free end 43 of the tab 40 is shown as bearing against the arcuate wall 51 of the cylindrical portion 46 of the opening 30 and the compressive force of the tab 40 being wedged thereagainst has forced the body portion 41 flat against the flat portion 48 of the elongated portion 47 of the opening 30.

Also, it can readily be seen in FIG. 7 that since the tab 40 is disposed against the arcuate surface 51 of the cylindrical portion 46 of the opening 30, the tab 40 has provided a centering action of the electrode 24 so as to properly laterally align the electrode 24 in the opening 30 whereby the electrode 24 will have its pointed end 37 disposed along a center line of the igniter body 21 which will coincide with the center line of the target electrode 23 when the igniter body 21 is assembled to the target bracket 22 in a manner hereinafter described.

Therefore, it can be seen that by forming the igniter body 21 and igniter electrode 24 in the manner previously described, the same can be assembled together by a relatively simple assembly step so that the electrode 24 is secured in an accurate position within the igniter body 21 solely by a wedging action provided between the electrode 24 and the igniter body 21 so that the electrode 24 is held in a fixed position in the igniter body 21 by such wedging action and without auxiliary fastening means.

The target bracket 22 of this invention can also be formed from the aforementioned 430 nickel-free stainless steel and can be stamped from a sheet thereof in strip form to be bent into its configuration by such stamping operation or subsequent thereto to define an inverted substantially U-shaped portion 52 comprising a substantially flat cross member 53 and a pair of depending legs 54 disposed substantially parallel to each other and having outwardly bent free ends 26 that are disposed substantially coplanar with each other and extend away from each other to define the mounting portions 26 previously described.

In particular, the mounting portions 26 can have cutouts 55 formed therein to receive the threaded fastening means 28 to fasten the mounting portions 26 to the frame means 27 in the manner illustrated in FIG. 4.

The cross member 53 of the target bracket 22 has the target electrode 23 carved therefrom and bent downwardly so as to be integral therewith and transverse thereto.

Figure 2:
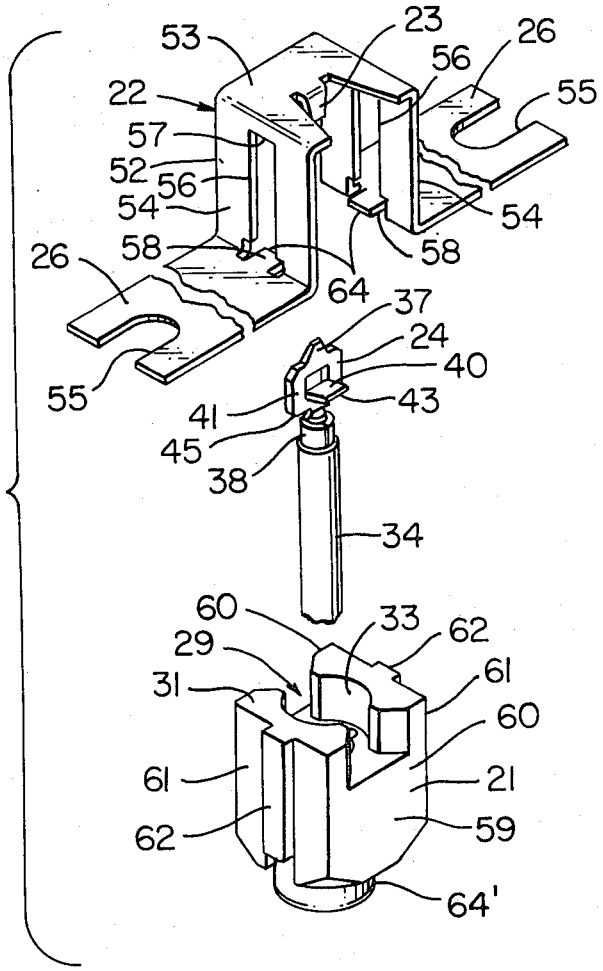
FIG. 2 is an exploded perspective view of the parts of the assembly of FIG. 1.

Each leg 54 of the U-shaped portion 52 has an elongated slot 56 formed therethrough and defining at the upper end thereof a flat stop surface 57 for a purpose hereinafter described and at the lower end thereof a tab means 58 which is adapted to be disposed substantially with its respective mounting portion 26 in the manner illustrated in FIGS. 2 and 4 and extend inwardly beyond its respective leg 54 for a purpose hereinafter described.

The tabs 58 of the target bracket 22 of this invention provide a means for holding the igniter body 21 thereto so that the completed assembly 20 illustrated in FIG. 1, and formed in a manner hereinafter described, is a self-contained unit that is adapted to be assembled as a one-piece unit to the frame means 27 in a manner hereinafter described.

The igniter body 21 of this invention is uniquely shaped so that the same has a substantially rectangular main body portion 59 defined by a first pair of opposed substantially flat sides 60 and another pair of opposed substantially flat sides 61, the sides 60 being interrupted by the channel means 29 for the purpose previously set forth.

However, the sides 61 of the body portion 59 of the igniter body 21 have a pair of outwardly extending elongated rectangular abutments 62 respectively having opposed ends 31 and 63 as illustrated, the abutments 62 being formed so that the same are adapted to be loosely received through the slots 56 in the legs 54 of the target bracket 22 in the manner illustrated in FIGS. 1 and 4.

Figure 9:
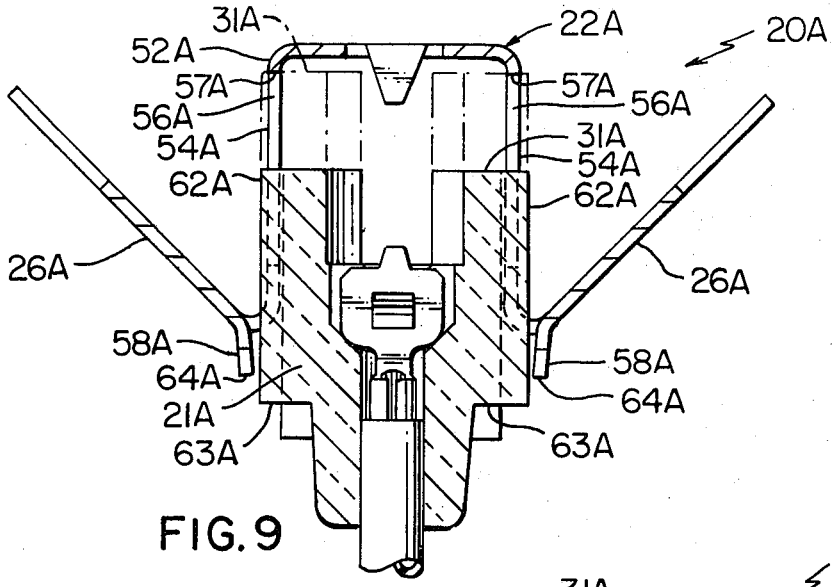
FIG. 9 is a fragmentary cross-section view illustrating another embodiment of this invention that comprises the combination of an igniter body and a target bracket, FIG. 9 illustrating one of the steps in the method of this invention for making the assembly of FIG. 12.

In particular, during the initial assembly of the igniter body 21 to the target bracket 22 after the igniter electrode 24 has been assembled to the igniter body 21 in the manner previously described, the igniter body 21 can be inserted upwardly into the U-shaped portion 52 of the target bracket 22 when the leg ends 26 are bent at angles relative thereto as illustrated in FIG. 9 so that the free ends 64 of the tabs 58 are clear from the igniter body 21 being so inserted. When the igniter body 21 is fully received in the U-shaped portion 52 with the abutments 62 thereof projecting out through the slots 56 in the manner illustrated in FIG. 10, the leg ends 26 are bent back into their coplanar position as illustrated in FIG. 11 to cause the tabs 58 to be disposed beneath the abutments 62 and engage against the lower surfaces 63 thereof to hold the igniter body 21 to the target bracket 22 in the manner illustrated in FIG. 1.

Thus, even though the slots 56 are slightly longer than the length of the abutments 62 of the igniter body 21, the igniter body 21 cannot slip out of its assembled position with the target bracket 22 as the lower surfaces 63 of the abutments 62 engage against the tabs 58 whereby the tabs 58 hold the ingiter body 21 to the target bracket 22.

Thus, it can be seen that the improved combination 20 of this invention can be subsequently secured as a single unit to the frame means 27 as the combination 20 of the target bracket 22 and igniter body 21 form a self-contained assembly once the igniter body 21 has been assembled to the target bracket 22 by the method of this invention in the manner previously described.

Figure 3:
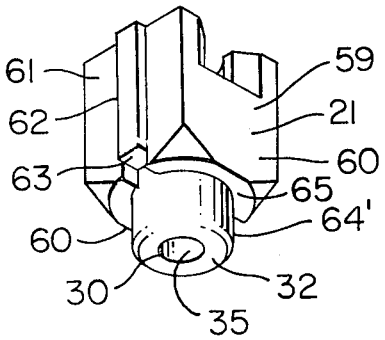
FIG. 3 is a bottom perspective view of the igniter body of the assembly of FIG. 2.

As illustrated in FIG. 3, the igniter body 21 has a substantially frusto-conical portion 64' depending from the main rectangular body portion 59 thereof and cooperates therewith to define a substantially annular flat shoulder or surface 65 disposed spaced below the lower surfaces 63 of the abutments 62 as well as below the normal coplanar mounting portions 26 for a purpose now to be described.

The frame means 27 of a suitable fuel burning appliance, such as a cooking apparatus or the like, has an opening 66 passing therethrough and is adapted to receive the frusto-conical portion 64' of the igniter body 21 therethrough in the manner illustrated in FIG. 4 whereby the annular shoulder 65 of the igniter body 21 rests against the upper surface 67 of the frame means 27 outboard of the opening 66 thereof as illustrated in FIG. 4. The subsequent fastening of the mounting portions 26 of the target bracket 22 downwardly against the surface 67 of the frame means 27 by the fastening members 28 assures that the upper stop surfaces 57 of the legs 54 of the target bracket 22 will be engaged by the upper stop surfaces 31 of the abutments 62 of the igniter body 21 as the legs 54 are pulled downwardly by the fastening of the portions 26 to the frame 27 so that the target electrode 23 will be properly spaced from the pointed end 37 of the igniter electrode 24 in the manner illustrated in FIG. 4 whereby the spark gap 25 will have the proper length for providing the desired electrical sparking operation between the subsequently charged electrode 24 and the grounded target electrode 23.

Thus, it can be seen that through the unique arrangement of the assembly 20, the target bracket and igniter body 21 can be assembled as a single item to the frame means 27 by merely inserting the frusto-conical portion 64' of the igniter body 21 through the opening 66 and, thereafter, fastening the mounting portions 26 of the target bracket 22 to the frame means 27 by the threaded fastening members 28 so that the assembly 20 is securely fastened to the frame means 27 and the assembly 20 automatically aligns itself whereby the spark gap 25 is of the proper length through the cooperation of the upper stop surfaces 31 of the abutments 62 of the igniter body 21 engaging against the upper stop surfaces 57 of the target bracket 22 in the manner previously described.

As previously stated, when the electrode 24 is charged by a suitable sparking unit electrically interconnected to the lead means 34, electrical sparking will take place across the spark gap 25 to ignite any fuel being directed into the channel 29 of the igniter body 21 by a flash tube arrangement so that the ignited fuel will, in turn, flash back through the flash tube arrangement to ignite the fuel issuing from the main burner means that initially directed the fuel to the igniter assembly 20 through the flash tube arrangement. Thus, it can be seen that the assembly 20 performs its igniting function in a conventional manner so that a further description of the operation thereof is not necessary.

While the embodiment 20 previously described has the igniter body 21 loosely assembled to the target bracket 22 so that the same is movable within the limits of the abutment means 62 engaging against the tabs 58 and the upper stop surfaces 57 as previously described, another embodiment of this invention is so formed that the holding tabs maintain the upper surfaces 31 of the abutments 62 against the upper stops 57 of the target bracket 22 in a biasing manner after the igniter body 21 is assembled thereto in a manner hereinafter set forth and upon subsequent fastening of the mounting portions 26 to the frame means 27, the tabs 58 provide even a greater biasing force holding the upper surfaces 31 of the abutments 62 against the upper stops 57 rather than relying upon the frame means 27 forcing the surfaces 31 against the upper stops 57 as in the embodiment of FIGS. 1–8 as previously described.

In particular, reference is now made to FIGS. 9–12 wherein another assembly of this invention is generally indicated by the reference numeral 20A and parts thereof similar to the assembly 20 previously described are indicated by like reference numerals followed by the reference letter "A."

As illustrated in FIGS. 9–12, the target bracket 22A and igniter body 21A are formed in the manner previously described for the target bracket 22 and igniter body 21 except that the free ends or mounting portions 26A of the target bracket 22A and the tabs 58A thereof initially have the shape illustrated in FIG. 9 so that is is a relatively simple step to insert the igniter body assembly 21A upwardly into the U-shaped portion 52A as the abutments 62A are completely disposed inboard of the tabs 58A during such insertion. Thus, it can be seen that the igniter body 21A can be inserted upwardly into the U-shaped portion 52A of the bracket 22A until the upper surfaces 31A of the abutments 62A are disposed against the upper stops 57A of the target bracket 22A as illustrated by the dash-dotted lines in FIG. 9.

Figure 10:
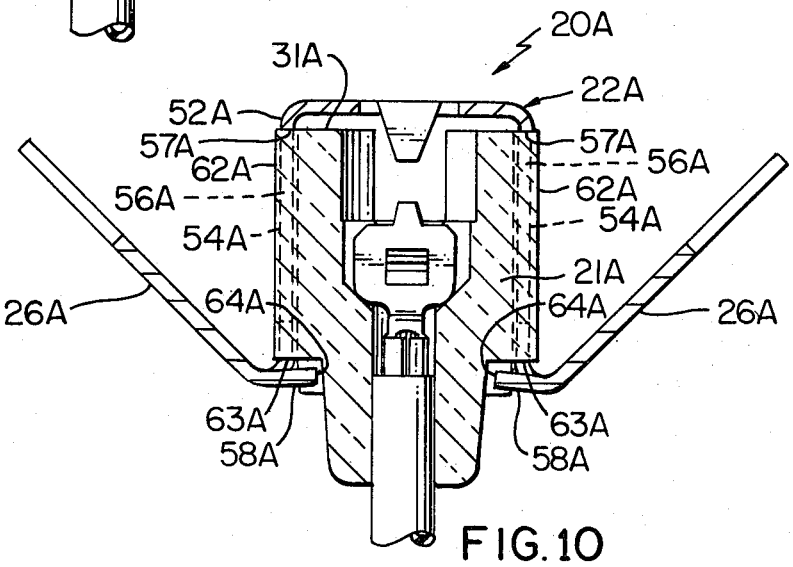
FIG. 10 is a view similar to FIG. 9 and illustrates another step in the method for making the assembly of FIG. 12.
Figure 11:
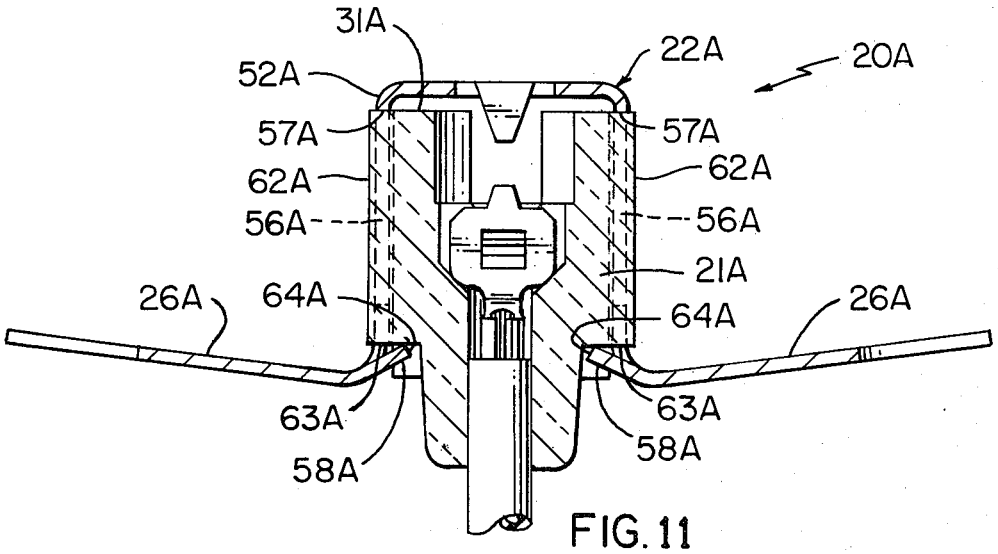
FIG. 11 is a view similar to FIG. 10 and illustrates another step in the method for making the assembly of FIG. 12.

Thereafter, the tabs 58A are bent from the angle illustrated in FIG. 9 to the angle illustrated in FIG. 10 whereby the same are now disposed inboard of the lower surfaces 63A of the abutment means 62A as illustrated in FIG. 10.

Thereafter, the mounting portions 26A of the legs 54A of the target bracket 22A are bent downwardly from the position illustrated in FIG. 10 to their normal mounting position from which they will spring back to the free position illustrated in FIG. 11 to dispose the same ascented from each other whereby it can be seen that the free ends 64A of the holding tabs 58A are now compressed against the lower surfaces 63A of the abutment means 62A to not only hold the upper surfaces 31A of the abutment means 62A against the upper stops 57A of the target bracket 22A, but also the tabs 58A are placed under compression and thereby provide a continuous biasing force holding such upper surfaces 31A of the abutment means 62A against the upper stops 57A as illustrated in FIG. 11.

Thus, it can be seen that the igniter body 21A is no longer movable within the target bracket 22A as the same is firmly held in the desired position with the upper surfaces 31A against the upper stops 57A.

Figure 12:
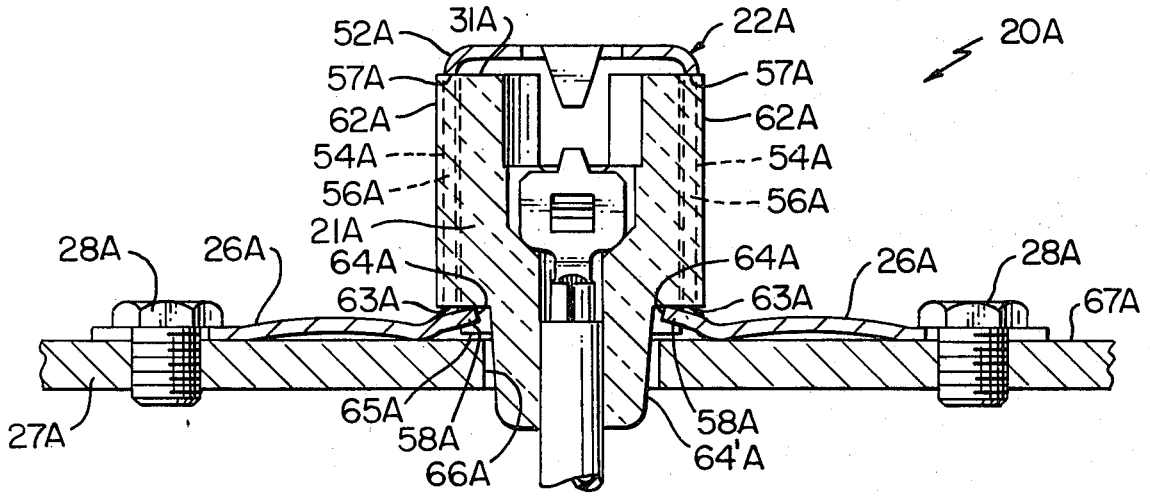

Subsequently, when it is desired to assemble the self-contained combination 20A to the frame means 27A as illustrated in FIG. 12, the frusto-conical portion 64A' of the igniter body 21A is inserted into the opening 66A of the frame means 27A as illustrated in FIG. 12. Thereafter, the mounting portions 26A of the target bracket 22A are fastened downwardly toward the upper surface 67A of the frame means 27A by threaded fastening members 28A which operation causes the heel portions of the mounting portions 26A to abut the upper surface 67A of the frame means 27A and the subsequent pull down of the legs 26A produce a lever action to provide an additional upward force on the tabs 58A to increase the compression force thereof urging the abutment means 62A upwardly against the upper stops 57A of the target bracket 22A to thereby more firmly hold the upper surfaces 31A of the abutment means 62A of the igniter body 21A against the stops 57A of the target bracket 22A with a greater biasing force so as to continuously and positively maintain the spark gap 25A of the proper length.

The arrangement of the self-contained combination 20A, previously described, was initiated by trying to solve the problem of utilizing the self-contained assembly 20 with a frame means 27 that had an opening 66 therethrough that was appreciably larger than the annular surface 65 of the igniter body 21 whereby the supporting surface 67 of the frame 27 to the annular surface 65 was lost.

Figure 15:
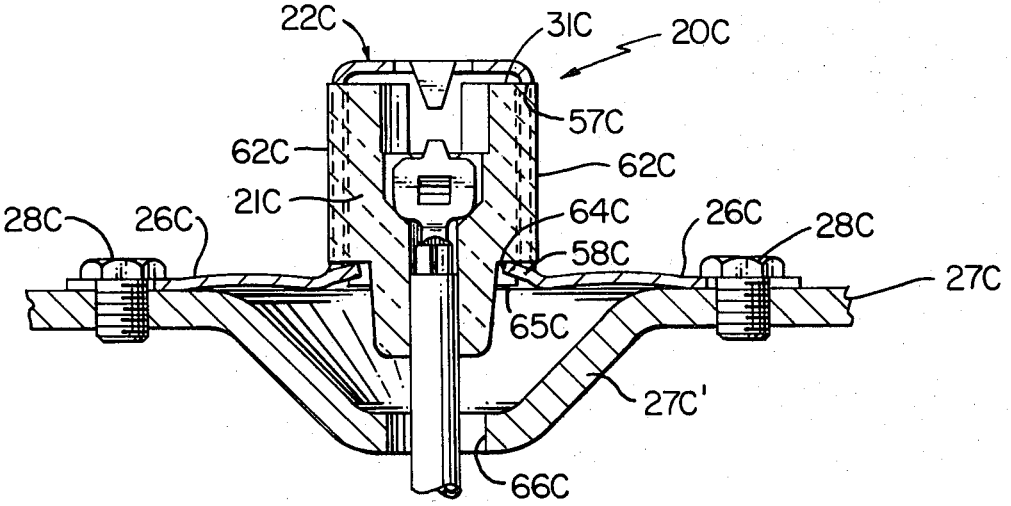
FIG. 15 is a view similar to FIG. 12 and illustrates another type of frame receiving the assembly of FIG. 9.

In particular, reference is now made to FIG. 15 wherein another assembly of this invention is generally indicated by the reference numeral 20C and parts thereof similar to the assemblies 20 and 20A previously described are indicated by like reference numerals followed by the reference letter "C".

As illustrated in FIG. 15, the self-contained combination 20C is substantially identical to the combination 20A previously described except that the same is mounted to a particular frame member 27C of an appliance with the frame member 27C having a drawn bell mouth cup 27C' in the upper side thereof whereby the opening 66C at the bottom of the cup 27C' can receive the igniter lead therethrough but is disposed completely below where the annular shoulder 65C of the igniter body 21C would be located when the combination 20C is secured to the frame 27C by the threaded fastening members 28C securing the mounting portions 26C of the target bracket 22C to the frame 27C as illustrated in FIG. 15. However, it can readily be seen that since the free ends 64C of the tabs 58C are continuously biasing the abutments 62C of the igniter body 21C upwardly by the compressed ends of the tabs 58C, as provided in the manner previously described in connection with the assembly steps of FIGS. 10 and 11, plus the added lever action on mounting as previously described except the fulcrum is at the rim of cup 27C' instead of the heels of the mounting legs 26C, the stop surfaces 31C of the abutments 62C are maintained in positive engagement with the upper stops 57C of the bracket 22C even though the igniter body 21C does not engage the frame 27C because of the large bell mouth 27C' in the frame 27C.

While the assemblies 20 and 20A of this invention, previously described, each has the igniter body 21 or 21A thereof engaged against the upper surface 67 or 67A of the frame means 27 or 27A so that for different appliances having different height requirements for the flash tube arrangements thereof, not only must the target brackets 22 or 22A have the legs 54 or 54A thereof of different heights, but also the igniter bodies 21 or 21A must have different heights to correspond thereto. However, it was found, according to the teachings of this invention, that the igniter body could be formed of the same length for different height locations above the appliance frames and that only the target brackets would need to have different lengths for different assemblies if the igniter body was not required to engage against the upper surface of the frame means.

Figure 13:
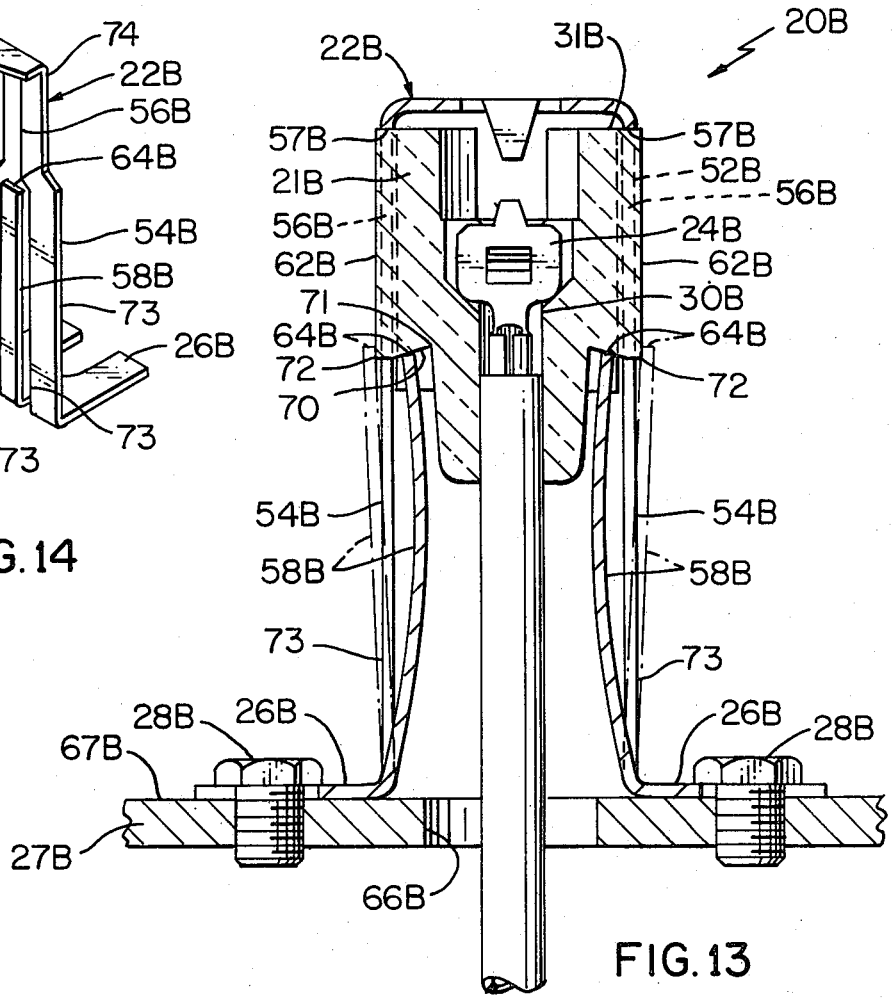
FIG. 13 is a view similar to FIG. 12 and illustrates aother embodiment of this invention that comprises the combination of an igniter body and a target bracket.

Accordingly, such an assembly of this invention is generally indicated by the reference numeral 20B in FIG. 13 and parts thereof similar to the assemblies 20 and 20A previously described will be indicated by like reference numerals followed by the reference letter "B".

As illustrated in FIG. 13, the igniter body 21B and the igniter electrode 24B are formed and assembled in the manner previously described except that in place of the flat surface 63 or 63A previously described for contact with tab 58 or 58A, such surface is replaced by an angular cam surface means 70 that is angled relative to the longitudinal axis of the stepped bore 30B so that the inner end portions 71 of the surface means 70 are higher than the leading edges 72 of the cam surface means 70 for a purpose hereinafter described.

Figure 14:
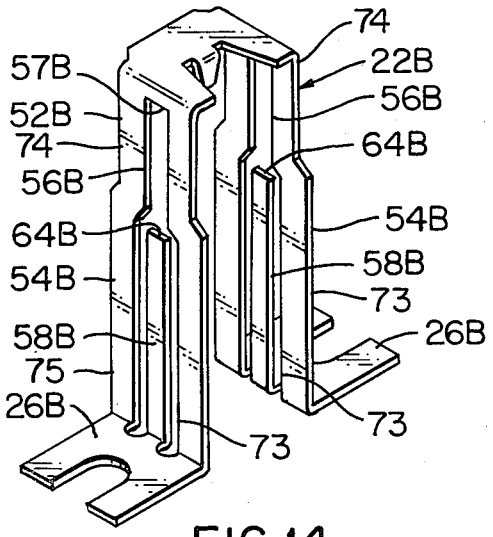
FIG. 14 is a perspective view of the improved target bracket of the assembly illustrated in FIG. 13.

The target bracket 22B of the assembly 20B has relatively long leg portions 54B of any desired height for each application thereof that define the U-shaped portion 52B thereof. The tabs 58B of the legs 54B are so constructed and arranged that the same are disposed substantially at right angles to the mounting portions 26B and extend substantially parallel to each other so that the free ends 64B thereof define the lower portions of the slot means 56B that receive the abutment means 62B of the igniter body 21B therein, the legs 58B being carved from a larger lower portion 73 of the slot means 56B as illustrated in FIG. 14.

When it is desired to assemble the igniter body 21B to the target bracket 22B, the completed assembly of the igniter body 21B and its igniter electrode 24B is inserted upwardly between the legs 54B of the target bracket 22B by forcing and spreading the same sufficiently apart so that the abutments 62B of the igniter body 21B can be received in the slots 56B with the upper surface 31B of the abutment means 62B being disposed against the upper stops 57B in the manner illustrated in FIG. 13, the tabs 58B being flexed outwardly to permit such insertion in the manner illustrated in dash-dotted lines in FIG. 13. With the igniter body 21B so inserted, it can be seen from the dash-dotted lines in FIG. 13 that the free ends 64B of the tabs 58B extend above the leading edges 72 of the cam surfaces 70 and overlap against the respective abutment means 62B.

In this manner, the legs 58B must be flexed inwardly in a bowed manner to snap the free ends 64B thereof beyond the leading parts 72 of the cam surfaces 70 in the manner illustrated in full lines in FIG. 13 whereby the free ends 64B thereof engage against the cam surfaces 70 adjacent the inner portions 71 thereof and thereby are snap fitted to the cam surfaces 70 of the igniter body 21B. Also, since the legs 58B are under compression and have a normal bias to return to the dash-dotted line position of FIG. 13, the upper free ends 64B of the legs 58B continuously cam against the cam surfaces 70 of the igniter body 21B to continuously bias the upper surfaces 31B of the abutment means 62B against the upper stops 57B of the target bracket 22B.

Thereafter, when it is desired to assemble the self-contained assembly 20B to the frame means 27B, the lead means 34B of the assembly 27B is inserted down through the opening 66B in the frame means 27B and the mounting portions 26B of the target bracket 22B are secured against the upper surface 67B of the frame means 27B by the threaded fastening members 28B in the manner previously described whereby the assembly 20B is secured to the frame means 27B in a relatively simple manner and the igniter body 21B is completely spaced from the upper surface 67B of the frame means 27B as the bowed tabs 58B continuously bias the upper stops 31B of the abutment means 62B against the upper stops 57B of the target bracket 22B to assure the proper spacing for the spark gap 25B for the reasons previously described.

Therefore, it can be seen that by merely forming the target brackets 22B to have legs 54B of different lengths, the same igniter body assembly 21B can be utilized therewith to be positioned at various heights above the upper surfaces 67B of the frame means 27B so as to meet different manufacturers flash tube specifications and arrangements.

While the target bracket 22B illustrated in FIG. 14 has the upper portions 74 of the legs 54B inwardly cut away, the same could be substantially straight with the lower portions 75 thereof if desired, because the cut away portions 74 are merely to accommodate a particular flash tube arrangement with confinements, whereby the cut away portions 74 provide additional minimum clearance between the upper igniter assembly 20B and such flash tube confinements, wherein the flash tubes are disposed closer together than normal.

It was found according to the teachings of this invention that the assembly 20B might have its limitations in respect to height accommodations relative to appliance frames 67B. In particular, as the working height decreases over that indicated by FIG. 13 and approaches that indicated by FIG. 12, it can be seen that a problem would arise in flexing the legs 58B of the target bracket 22B to provide the same action as exhibited by a relatively long leg 58B. However, it was also found that the concept used in the assembly 20A of FIGS. 12 and 15 adapts itself quite readily to accommodate for height variations beyond the base height indicated by FIG. 4.

Accordingly, reference is now made to FIGS. 16–19 wherein another self contained assembly of this invention is generally indicated by the reference numeral 20D and parts thereof similar to the other assemblies 20, 20A, 20B and 20C are indicated by like reference numerals followed by the reference letter "D".

Figure 16:
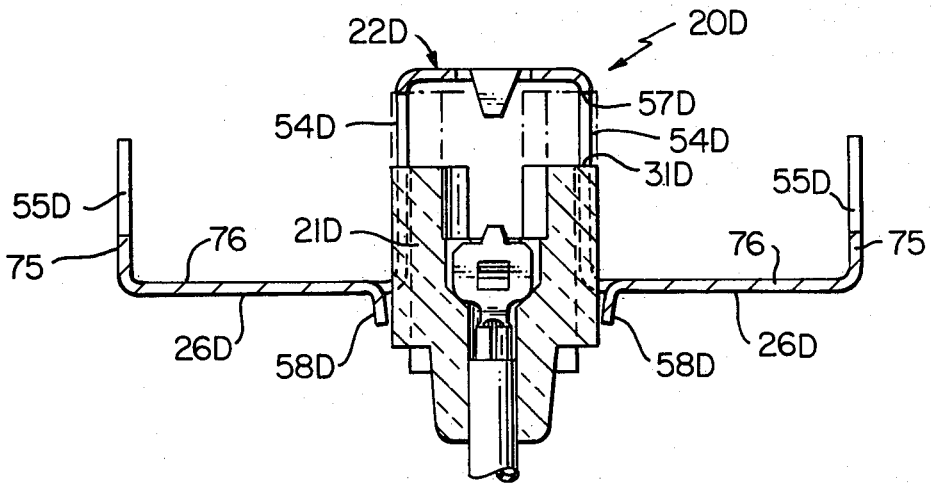
FIG. 16 is a fragmentary cross-sectional view illustrating another embodiment of this invention which comprises the combination of an igniter body and a target bracket, FIG. 16 illustrating one of the steps in the method of this invention for making the assembly of FIG. 19.

As illustrated in FIG. 16, the target bracket 22D has the leg portions 26D thereof initially bent at a right angle to the legs 54D thereof with the free end portions 75 that contain the slot openings 55D in turn bent at right angles relative to the remaining portions 76 of the legs 26B, the tabs 58D being bent downwardly as illustrated in FIG. 16 to permit easy insertion of the completed igniter body assembly 21D into the target bracket 22D as illustrated in FIG. 16.

Figure 17:
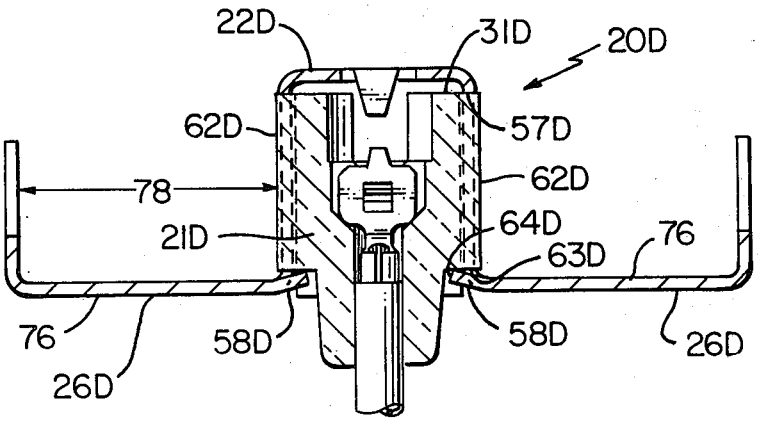
FIG. 17 is a view similar to FIG. 16 and illustrates another step in the method for making the assembly of FIG. 19.

Once the assembly 21D has been fully inserted into the target bracket 22D with the stop means 31D of the igniter body 21D disposed against the stops 57D of the target bracket 22D as illustrated in FIG. 17, the tabs 58D are bent upwardly so that the free ends 64D thereof are disposed against the lower ends 63D of the abutments 62D of the igniter body 21D as illustrated in FIG. 17.

Figure 18:
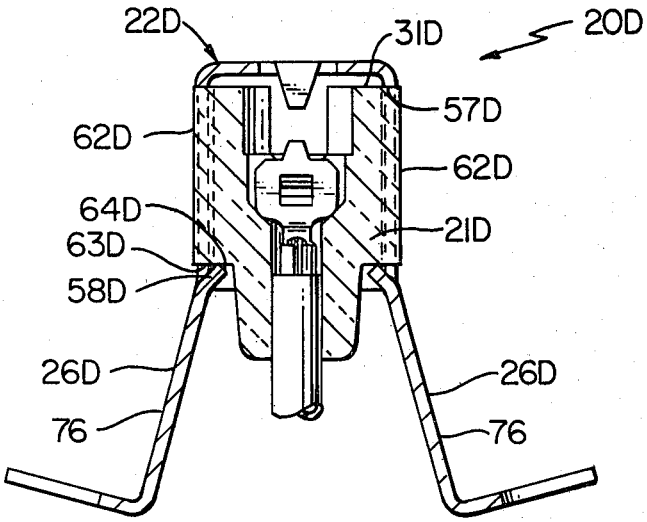
FIG. 18 is a view similar to FIG. 17 and illustrates another step in the method for making the assembly of FIG. 19.

Thereafter, by bending the leg portions 76 of the mounting portions 26D of the target bracket 22D downwardly into generally parallel relation as illustrated in FIG. 18, the contact points of the free ends 64D of the tabs 58D with the surfaces 63D of the assembly 21D serve as a fulcrum for the bending together of the leg sections 76 as illustrated in FIG. 18 to maintain a positive biasing force of the tabs 58D on the abutments 62D to maintain the stops 31D thereof in positive contact with the stops 57D of the target bracket 22D as illustrated in FIG. 18.

Figure 19:
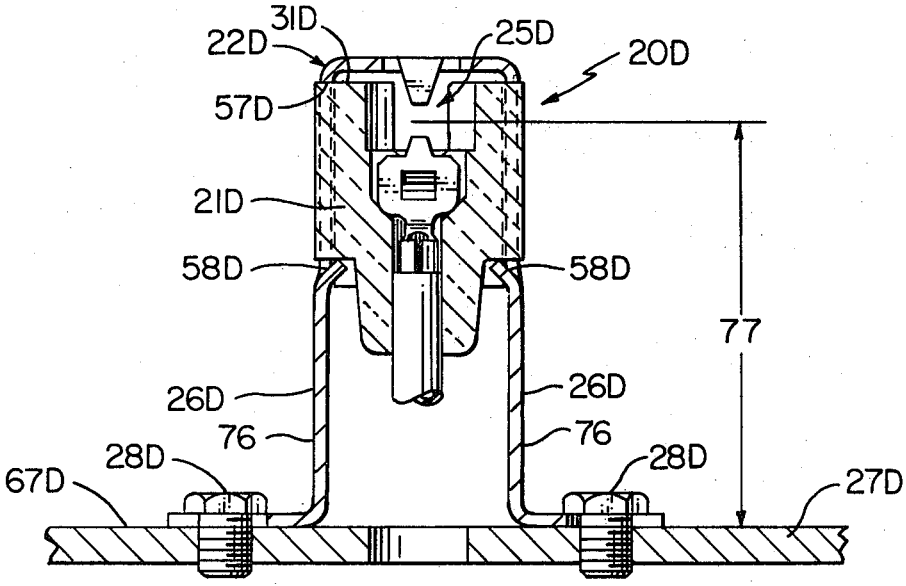

By initially bending the sections 76 of the legs 26D so that the same slightly cant outwardly as illustrated in FIG. 18, the tabs 58D will not be overstressed so that when the assembly 20D is to be mounted to the appliance frame 27D, as illustrated in FIG. 19, by the threaded fastening means 28D in the manner previously described, the further bending of the legs 76 into a more parallel relation from the canted position illustrated in FIG. 18 to the position illustrated in FIG. 19 further increases the biasing force on the tabs 58D maintaining the igniter assembly 21D with its stops 31D in positive contact with the stops 57D of the target bracket 22D for the reasons previously set forth.

Therefore, it is apparent that the height indicated by the reference numeral 77 in FIG. 19 for positioning the spark gap 25D of the assembly 20D above the surface 67D of the frame 27D is controlled by the initial length of the leg sections 76 as indicated by the reference numeral 78 in FIG. 17 whereby any height 77 is possible beyond the base height of FIG. 4 with the assembly 20D of this invention as long as the leg sections 26D are initially made long enough.

Figure 21:
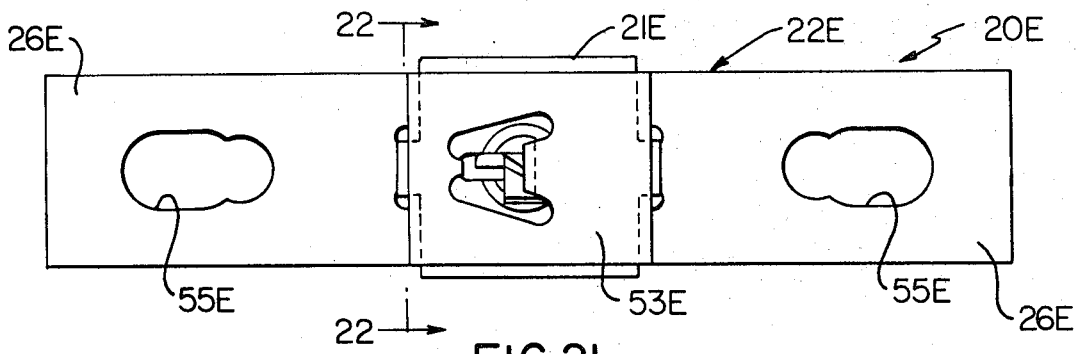
FIG. 21 is a top view of the embodiment of FIG. 20.
Figure 20:
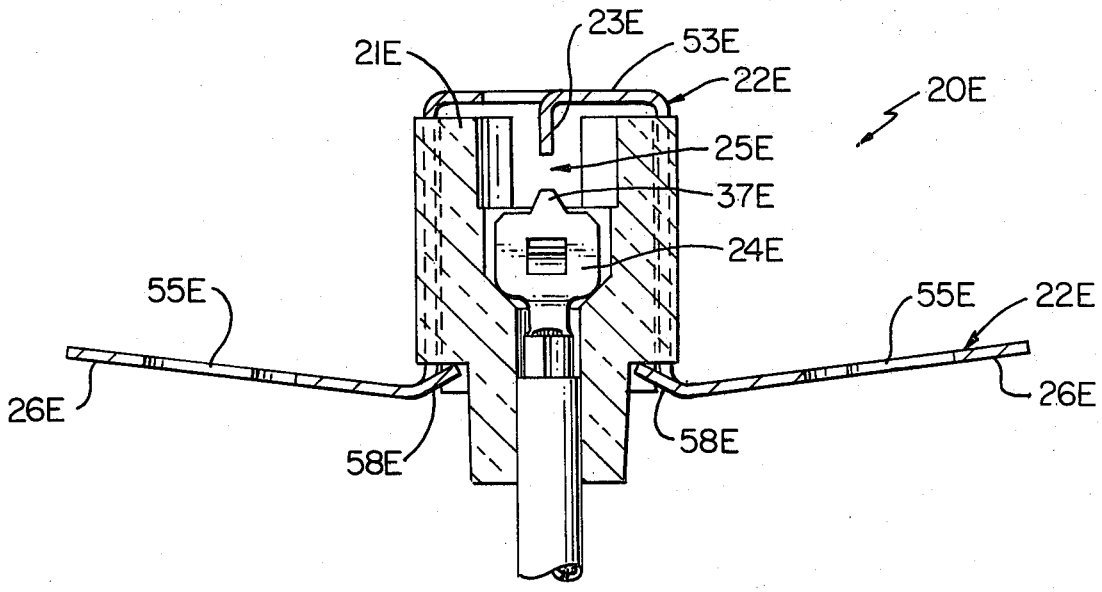
FIG. 20 is a view similar to FIG. 9 and illustrates another embodiment of this invention that comprises the combination of an igniter body and a target bracket therefor.
Figure 22:
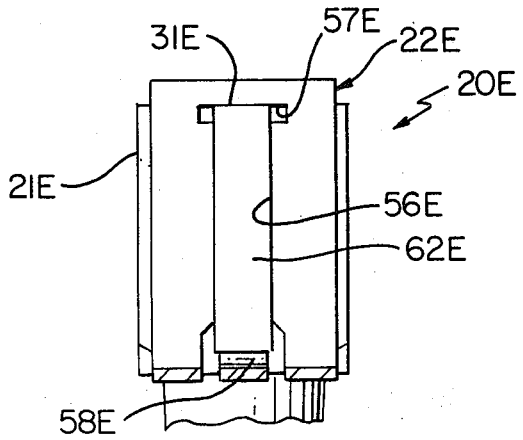
FIG. 22 is a fragmentary view taken on line 22–22 of FIG. 21.

Another self-contained assembly of this invention is generally indicated by the reference numeral 20E in FIGS. 20–22 and parts thereof similar to the other assemblies 20, 20A, 20B, 20C and 20D previously described are indicated by like reference numerals followed by the reference letter "E".

As illustrated in FIGS. 21 and 22, it can be seen that the width of the target bracket 22E is narrower than the other target brackets of this invention while the igniter body 21E remains of the same width as the other igniter bodies of this invention. The narrower target body 22E was found to be advantageous from a manufacturing standpoint to minimize waste and utilize stock of the bracket width.

However, because the width of the material forming the target bracket 22E is relatively narrow, it was found desirable to form elongated mounting holes 55E in the legs 26E rather than utilize the open ended slots 55 of FIG. 1.

Also, it was found desirable to maintain as much of the cross member 53E of the target bracket 22E in a covered condition to improve the channeling of the gas mixture to the ignition spark gap 25E. Thus, the target electrode 23E is carved from the cross member 53E of the target bracket 22E in a ninety degree change of position from the target electrode 23 previously described and the tip 37E of the igniter electrode 24E is bent so as to be directly located below the pointed end of the target electrode 23E regardless of whether the electrode 23E is hinged to the right or to the left of the cross member 53E.

Accordingly, it can be seen that the assembly of the igniter body 21E in the target electrode 23E can take place in the manner previously described and it makes no difference whether the target bracket 22E is assembled with the igniter body 21E in the manner illustrated in FIG. 21 or turned 180° therewith.

Thus, the completed assembly 20E can be secured to a frame means in the manner previously described for the other assemblies of this invention, such as the assembly 20A illustrated in FIG. 12, in order to maintain positive positioning of the igniter electrode 24E with the target electrode 23E.

While the various embodiments of this invention previously described have the improved igniter electrode thereof mounted within an igniter body that is to be joined to a target bracket before the assembly of the igniter body and target bracket are assembled to a frame means, it is to be understood that the improved igniter electrode of this invention can be utilized with an igniter body that is to be mounted to the frame means separately from the target bracket if desired.

Figure 23:
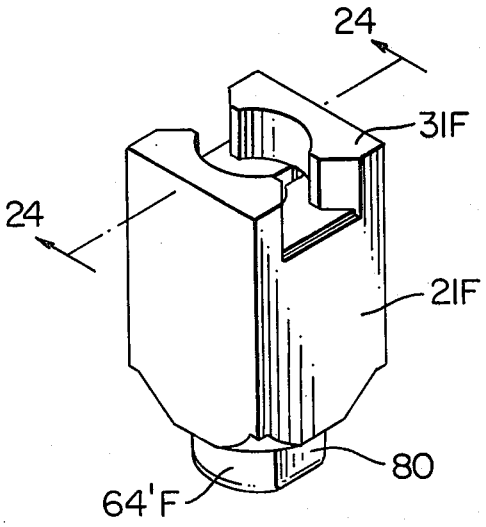
FIG. 23 is a top perspective view of another embodiment of an igniter body of this invention.
Figure 24:
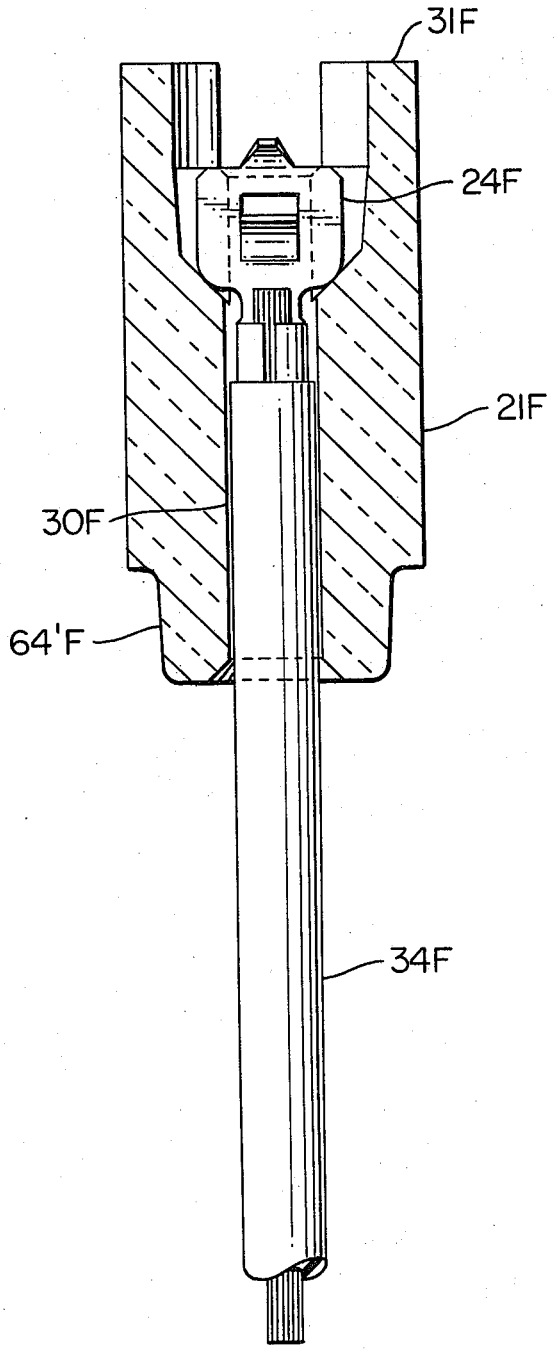
FIG. 24 is an enlarged cross-sectional view taken on line 24—24 of FIG. 23 and illustrates the igniter body of FIG. 23 with an igniter electrode assembled thereto.
Figure 25:
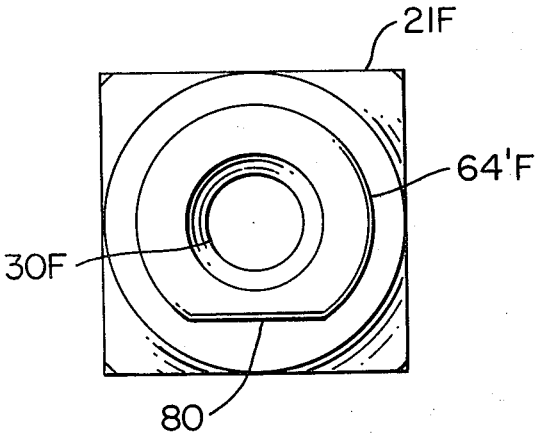
FIG. 25 is an enlarged bottom view of the igniter body of FIG. 23.

For example, reference is now made to FIGS. 23–25 wherein another igniter body of this invention is indicated by the reference numeral 21F and parts thereof similar to the other igniter bodies 21 and igniter electrodes 24 therefor are indicateed by like reference numerals followed by the reference letter "F".

Figure 5:
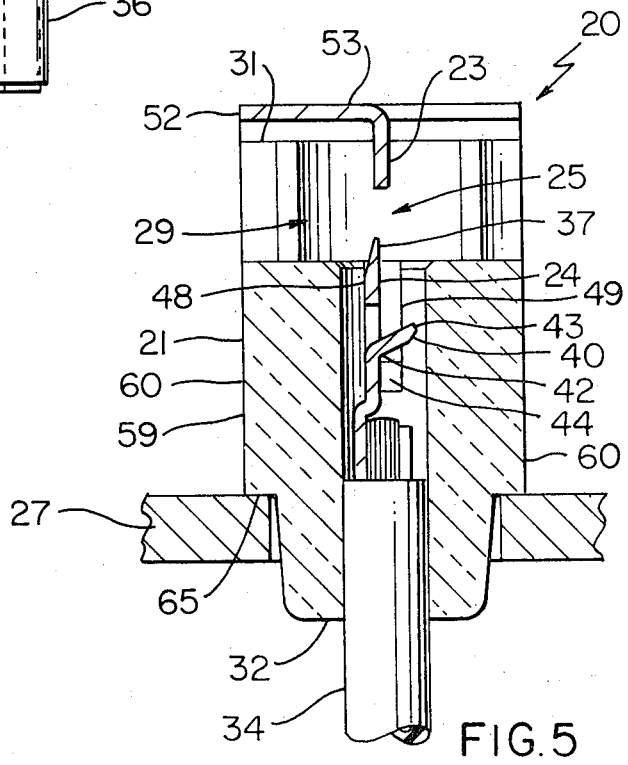
FIG. 5 is a fragmentary cross-sectional view taken on line 5—5 of FIG. 4.
Figure 6:
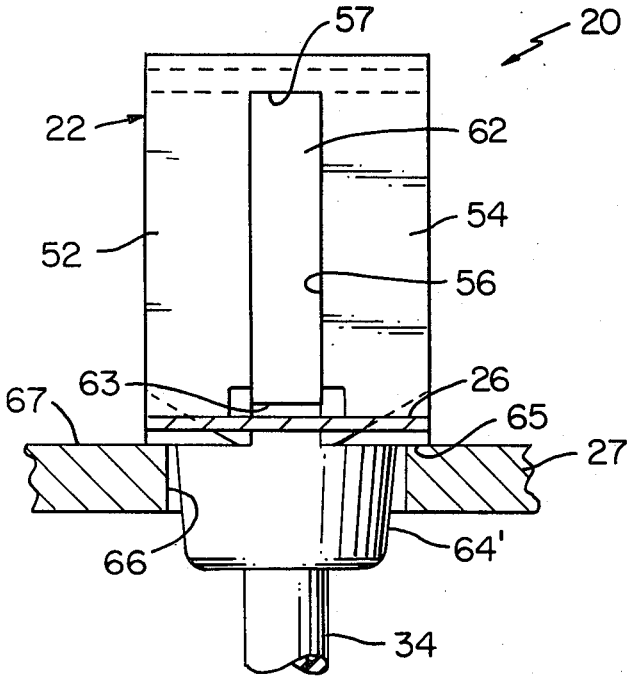
FIG. 6 is a fragmentary cross-sectional view taken on line 6—6 of FIG. 4.

As illustrated in FIGS. 23–25, the igniter body 21F is substantially the same as the igniter body 21 previously described except that the igniter body 21F does not have the side abutment 62 because the igniter body 21F is to be mounted in an opening of a frame means (not shown) by having the lower reduced portion 64'F thereof inserted through a suitable opening in the frame means as illustrated in FIG. 5 for the igniter body 21 and be held therein by any suitable part of the target bracket structure that will engage against the top 31F of the igniter body 21F in any desired manner. If desired, the lower portion 64'F of the igniter body 21F can be provided with a flattened side 80 to mate with a cooperating straight section of the opening in the frame means to orient the rotational position of the igniter body 21F therein.

In any event, it can be seen that the igniter body 21F has the same shaped opening 30F formed therethrough for receiving the electrode 24F and its lead means 34F in exactly the same manner as the electrode 24 and opening 30 of the igniter body 21 previously described.

Therefore, it can be seen that the improved igniter electrode 24 of this invention can be utilized with different types of igniter bodies as desired as the improved electrode 24 of this invention has many unique features as previously described.

As previously stated, it was found according to the teachings of this invention that when an igniter body and its associated igniter electrode are being mounted to a frame means independently from the target bracket thereof, the projecting part, such as part 64'F of the igniter body 21F of FIG. 24, is inserted through an opening in a frame means and some type of fastening means is thereafter disposed underneath the frame means to attach to the projecting part of the igniter body to tend to secure the same to the frame means so that the upper portion of the igniter body will position the igniter electrode properly above that side of the frame means. However, it was found according to the teachings of this invention that there is not sufficient room to reach under such frame means to properly position the fastening means to positively hold the igniter body in the desired position so that the resulting spark gap with the target bracket subsequently mounted to the frame means will be accurately maintained.

Accordingly, it was found according to the teachings of this invention that the igniter body could be so uniquely shaped and constructed that the same could be inserted through the opening in the frame means from the under side thereof so that the part that projects through the opening means will be above the frame means and can receive a fastening means thereon that will accurately hold the igniter body to the frame means with the projecting part of the igniter body carrying the igniter electrode to be properly positioned above the upper surface of the frame means.

For example, reference is now made to FIGS. 26–28 wherein another improved combination of this invention is generally indicated by the reference numeral 90 and comprises a uniquely shaped igniter body 91 mounted in an opening means 92 of a frame plate 93, such as a frame plate of a cooking apparatus or the like, and being held thereto in an accurate manner by a conventional washer-like fastening member 94 in a manner hereinafter set forth.

Figure 28:
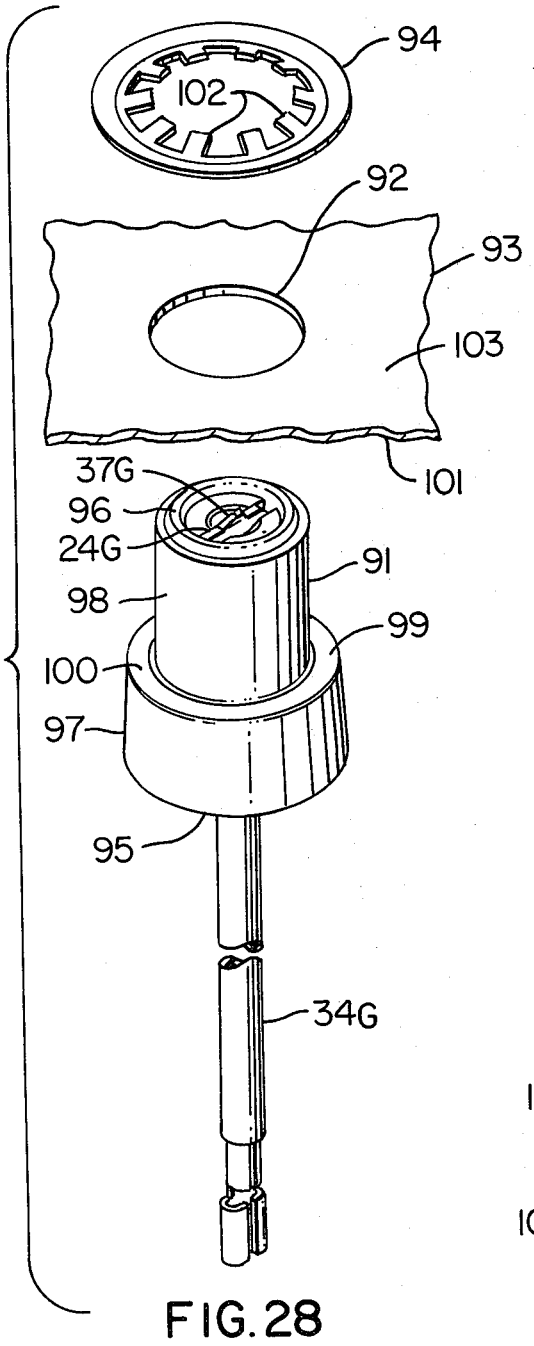
FIG. 28 is an exploded perspective view of the various parts that form the assembly of FIG. 26.
Figure 27:
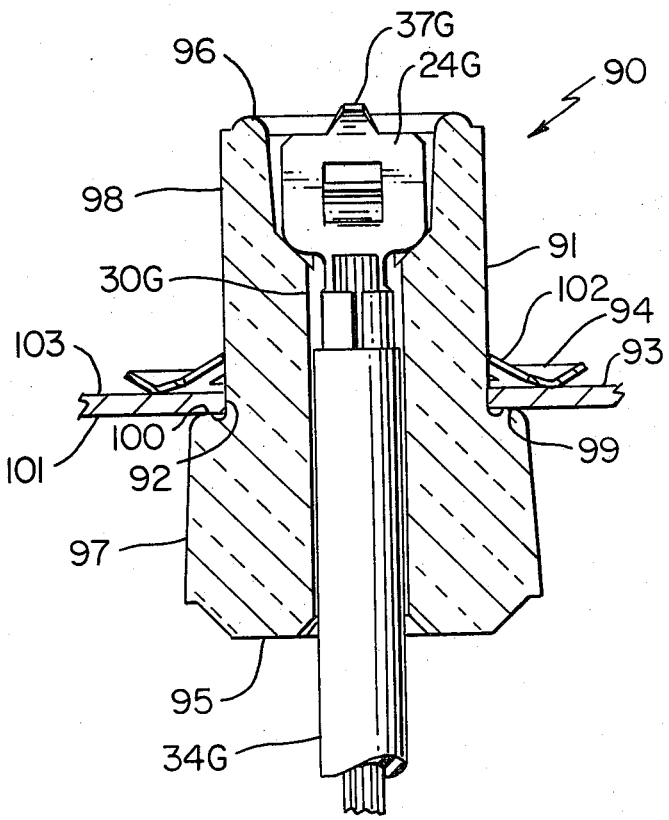
FIG. 27 is an enlarged fragmentary cross-sectional view taken on line 27—27 of FIG. 26.

As illustrated in FIGS. 27 and 28, the improved igniter body 91 of this invention has an opening 30G passing through opposed ends 95 and 96 thereof and receiving an igniter electrode 24G and its lead means 34G therein substantially in the same manner as the opening 30 and igniter electrode 24 previously described whereby the opening 30G and igniter electrode 24G need not be further described except to state that the tip 37G of the igniter electrode 24G projects slightly above the upper end 96 of the igniter body 91 as illustrated because of the unique target bracket (not shown) subsequently utilized therewith and mounted to the frame plate 93 in any suitable manner independently from the mounting means of the igniter body 91 which is now to be described.

The igniter body 91 is formed of two sections or portions 97 and 98 joined together by an annular shoulder means 99 that has an arcuate or convex surface or bead 100 for engaging against the under surface 101 of the frame plate 93 when the smaller portion 98 of the igniter body 91 is inserted upwardly through the opening 92 of the frame plate 93 as illustrated in FIG. 28.

It can be seen that the upper portion 98 of the igniter body 91 is substantially cylindrical whereas the lower larger portion 97 of the igniter body 91 is substantially frusto-conical in configuration with its smaller end being adjacent the annular shoulder means 99.

The washer-like fastening member 94 has a plurality of inwardly directed radial spring fingers 102 which when telescoped down over the cylindrical portion 98 of the igniter body 91 will tend to prevent the portion 98 of the igniter body 91 from being pulled downwardly out of the opening 91 because of the toggle effect of the spring fingers 102 in a manner well known in the art. However, it is to be understood that other types of push-on fastening members can be used, if desired.

Thus, it can be seen that the igniter body 91 is first inserted upwardly through the opening 92 to have the annular shoulder 99 thereof abut against the under surface 101 of the frame plate 93 and be held thereagainst while the fastening member 94 is then telescoped down over the upper portion 98 of the igniter body 91 until the fastening member 94 engages against the upper surface 103 of the frame plate 93 as illustrated in FIG. 27. In this manner, the fastening member 94 firmly holds the igniter body 91 in the proper position in the opening 92 of the frame plate 93 with the convex surface 100 of the shoulder means 99 flush against the under surface 101 of the frame plate 93 so that the tip 37G of the igniter electrode 24G is properly positioned above the upper surface 103 of the frame plate 93 to provide the proper length spark gap with the target bracket that is subsequently utilized with the assembly 90.

Figure 31:
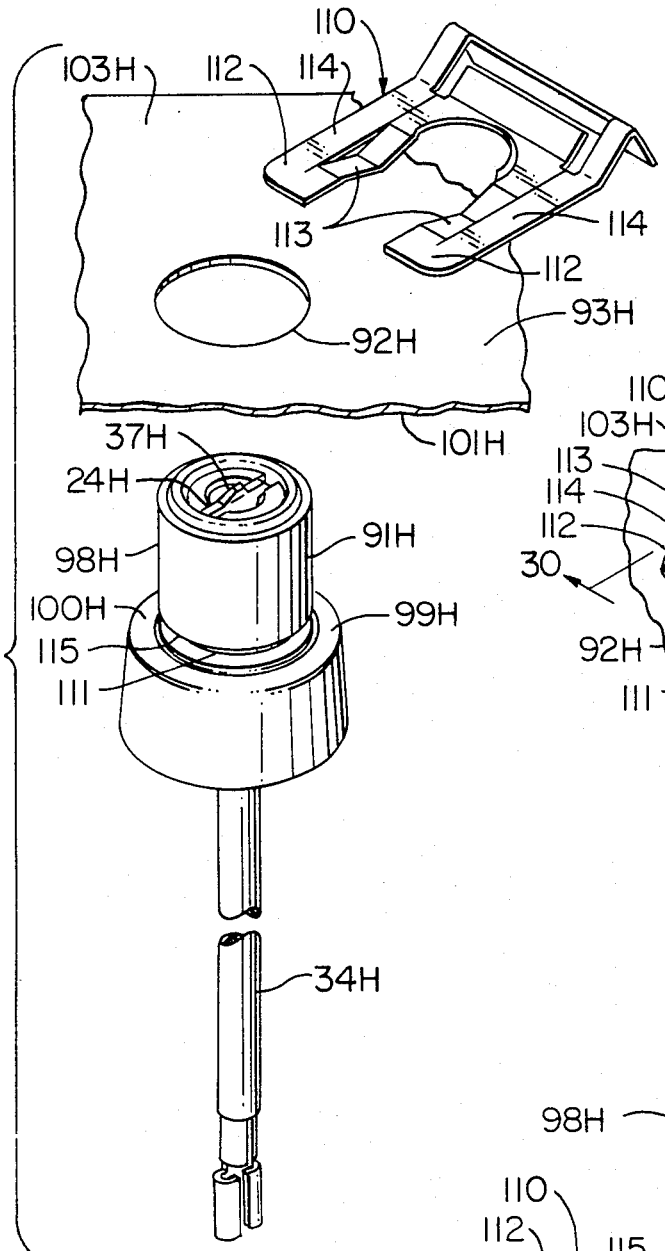
FIG. 31 is an exploded perspective view of the various parts that form the assembly of FIG. 29.
Figure 29:
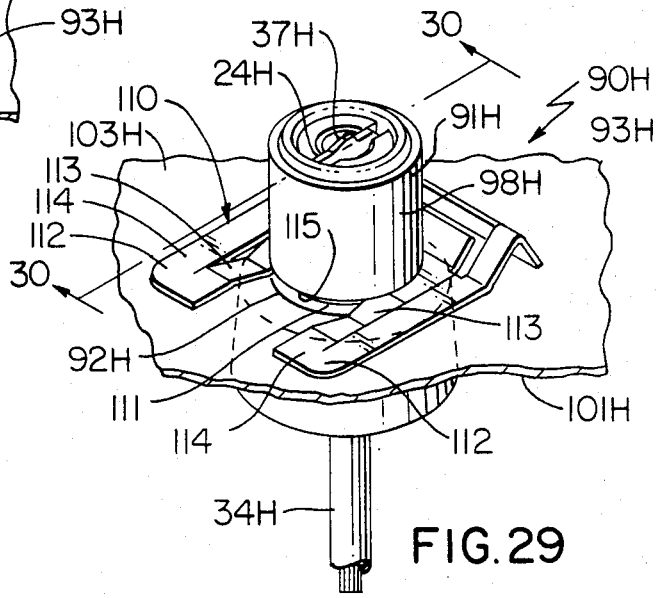
FIG. 29 is a view similar to FIG. 26 and illustrates another embodiment of this invention.
Figure 30:
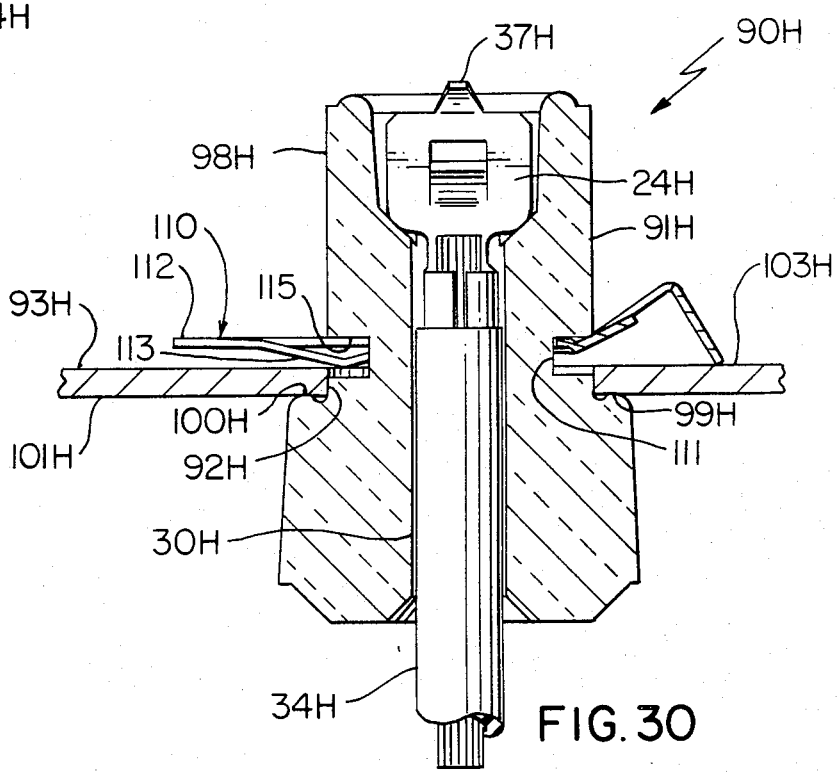
FIG. 30 is an enlarged fragmentary cross-sectional view taken on line 30—30 of FIG. 29.

Another improved combination of this invention is generally indicated by the reference numeral 90H in FIGS. 29–31 and parts thereof similar to the combination 90 previously described are indicated by like reference numerals followed by the reference letter "H".

As illustrated in FIGS. 29–31, it can be seen that the combination 90H includes the igniter body 91H mounted in the opening 92H of the frame plate 93H and being secured therein by a fastening means 110 in a manner hereinafter described to hold the igniter electrode 24H in its proper position above the upper surface 103H of the frame plate 93H in a manner hereinafter described.

The igniter body 91H is substantially the same as the igniter body 91 previously described except that the igniter body 91H has an annular recess 111 formed in the smaller upper section 98H thereof and spaced a certain distance above the annular bead or convex surface 100H of the annular shoulder 99H as illustrated in FIG. 30 so as to receive part of the fastening means 110 therein as will be apparent hereinafter. However, the opening 30H and igniter electrode 24H are identical to the opening 30G and electrode 24G previously described.

Figure 26:
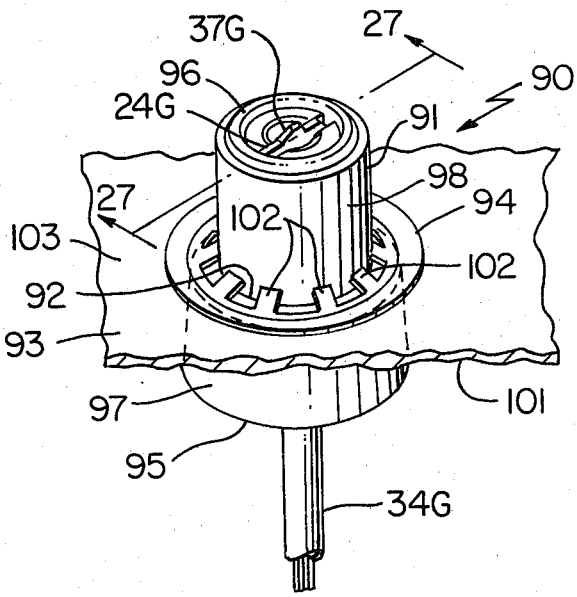
FIG. 26 is a fragmentary top perspective view of an improved assembly of this invention that comprises an improved igniter body of this invention assembled to a frame means.

In fact, it can be seen that by making the igniter body 91 as illustrated in FIGS. 26–28, that igniter body 91 can be utilized in the manner illustrated in FIGS. 26–28 or can subsequently have the annular groove 110 formed therein to form the assembly 90H in a manner now to be described.

The fastening member 110 is a commercially available fastening member that can be purchased under the trade name "Tinnerman Clip," so that only sufficient details thereof to understand the features of this invention will now be described.

In particular, the clip or fastening member 110 has a pair of bifurcated legs 112 and is suitably bent and folded to define two resilient portions 113 and 113 of the legs 112 which project downwardly away from the upper sides 114 of the legs 112 to provide a resiliency to the legs 112 as will be apparent hereinafter.

When it is desired to form the assembly 90H of this invention, the igniter body 91H with its assembled igniter electrode 24H has the upper portion 98H thereof inserted upwardly through the opening 92H of the frame plate 93H until the annular bead 100H of the annular shoulder 99H abuts against the under surface 101H of the frame plate 93h. Thereafter, the fastening member 110 is moved along the surface 103H of the frame plate 93H so that the legs 112 thereof will have portions thereof not only straddling the upper cylindrical portion 98H of the igniter body 91H, but also those portions of the legs 112 will be received in the annular recess 111 whereby the legs 112 not only engage against the upper resulting shoulder 115 of the igniter body 91H, but also bear against the upper surface 103H of the frame plate 93H. In this manner, the portions 113 of the legs 112 are under compression and thereby continuously impose an upwardly acting biasing force on the igniter body 91H to continuously urge the annular bead 100H of the annular shoulder 99H in engagement with the under surface 101H of the frame plate 93H so that the tip 37H of the electrode 24H is properly positioned above the upper surface 103H of the frame plate 93H for accurately defining a spark gap with a resulting target bracket subsequently mounted against the frame plate 93H in any suitable manner.

It is believed that the assembly 90H will be easier to install in the field than the assembly 90 whereas the assembly 90 readily lends itself to installation in a factory or the like wherein the annular shoulder 99 of the igniter body 91G can be held against the surface 101 of the frame plate 93 when the fastening member 94 is being telescoped over the upper portion 98 of the igniter body 91. In contrast, the fastening member 110 of the assembly 90H performs the function of biasing the shoulder 99H into engagement with the under surface 101H of the frame means 93H so that the shoulder 99H need not be initially held tightly against the surface 101H before and while the fastening member 110 is being assembled thereto.

In any event, it can be seen that the assemblies 90 and 90H of FIGS. 26–31 not only each provide an improved combination of an igniter body and a frame means and method of making the same, but also each provides improved igniter bodies and methods of making the same.

While the various forms and methods of this invention, now preferred, have been illustrated and described as required by the Patent Statute, it is to be understood that other forms and method steps can be utilized and still fall within the scope of the appended claims.

What is claimed is:

1. In a method of making a combination of a substantially stationary frame means of a cooking apparatus or the like and an electrically insulating igniter body in an opening passing through opposed sides of said frame means so that an igniter electrode carried by said igniter body projects beyond one of said sides of said frame means and lead means of said igniter electrode extends beyond the other of said sides of said frame means, the method comprising the steps of forming said one side of said frame means to be a top side of said frame means whereby said other side is a bottom side of said frame means, forming said igniter body as a one-piece member having intergal medial shoulder means, abutting said shoulder means against said frame means, and engaging fastening means against said frame means while operatively interconnecting said fastening means to said igniter body to hold said shoulder means thereof against said frame means, the improvement wherein said steps of forming, abutting and engaging causes said shoulder means to abut said bottom side of said frame means and said fastening means to engage said top side of said frame means by first inserting said igniter body into said opening from said bottom side of said frame means until said shoulder means abuts said bottom side and then while holding said igniter body substantially in such position interconnecting said fastening means to the portion of said igniter body that projects beyond said top side of said frame means.

2. A method of making a combination as set forth in claim 1 and including the step of forming said shoulder means to be annular.

3. A method of making a combination as set forth in claim 2 and including the steps of forming said igniter body to have opposed end portions, and forming said annular shoulder means to define a step between said end portions whereby the end portion disposed adjacent said bottom side of said frame means is larger than the other end portion.

4. A method of making a combination as set forth in claim 3 and including the step of forming said other end portion of said igniter body to be substantially cylindrical.

5. A method of making a combination as set forth in claim 4 and including the step of forming said end portion of said igniter body that is disposed adjacent said bottom side of said frame means to be substantially frusto-conical.

6. A method of making a combination as set forth in claim 1 and including the step of forming said fastening means to comprise a washer-like member telescoped on said igniter body and having resilient fingers substantially radially engaging said igniter body on said top side of said frame means.

7. A method of making a combination as set forth in claim 1 and including the step of placing said fastening means under compression so as to impose a biasing force holding said shoulder means of said igniter body against said bottom side of said frame means.

8. A method of making a combination as set forth in claim 1 and including the steps of forming said igniter body to have a recess means therein adjacent said shoulder means and disposing a portion of said fastening means in said recess means to operatively interconnect said fastening means to said igniter body.

9. A method of making a combination as set forth in claim 8 and including the steps of forming said recess means to define another shoulder means of said igniter body that faces the first-mentioned shoulder means, and engaging said fastening means against said other shoulder means.

10. A method of making a combination as set forth in claim 9 and including the step of placing said fastening means under compression between said other shoulder means and said top side of said frame means to thereby impose a biasing force holding said first-mentioned shoulder means of said igniter body against said bottom side of said frame means.

* * * * *